US007942348B2

(12) United States Patent
Reiter

(10) Patent No.: US 7,942,348 B2
(45) Date of Patent: May 17, 2011

(54) FUEL INJECTOR

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 726 days.

(21) Appl. No.: 11/189,604

(22) Filed: Jul. 25, 2005

(65) Prior Publication Data

US 2006/0027685 A1 Feb. 9, 2006

(30) Foreign Application Priority Data

Aug. 3, 2004 (DE) ..... 10 2004 037 541

(51) Int. Cl.
*F02M 1/00* (2006.01)

(52) U.S. Cl. ..... 239/585.1; 239/533.2; 123/470

(58) Field of Classification Search .... 239/585.1–585.5, 239/533.2; 123/470
See application file for complete search history.

(56) References Cited

U.S. PATENT DOCUMENTS

| | | | | | |
|---|---|---|---|---|---|
| 4,610,080 | A | * | 9/1986 | Hensley | 29/602.1 |
| 4,621,788 | A | | 11/1986 | DeLew et al. | |
| 4,726,389 | A | * | 2/1988 | Minoura et al. | 137/1 |
| 5,086,980 | A | * | 2/1992 | Hickey | 239/585.3 |
| 5,150,842 | A | * | 9/1992 | Hickey | 239/585.4 |
| 5,236,174 | A | * | 8/1993 | Vogt et al. | 251/129.21 |
| 5,494,223 | A | * | 2/1996 | Hall et al. | 239/585.5 |
| 5,494,225 | A | * | 2/1996 | Nally et al. | 239/585.5 |
| 5,518,185 | A | * | 5/1996 | Takeda et al. | 239/585.4 |
| 5,580,001 | A | * | 12/1996 | Romann et al. | 239/585.4 |
| 5,823,445 | A | * | 10/1998 | Sofer | 239/585.1 |
| 6,012,655 | A | * | 1/2000 | Maier | 239/585.4 |
| 6,042,082 | A | * | 3/2000 | Graner et al. | 251/129.21 |
| 6,163,011 | A | * | 12/2000 | Urushizaki et al. | 219/121.64 |
| 6,328,231 | B1 | * | 12/2001 | Ording et al. | 239/585.1 |
| 6,382,532 | B1 | * | 5/2002 | French et al. | 239/585.1 |
| 6,405,427 | B2 | * | 6/2002 | Kummer | 29/606 |
| 6,481,646 | B1 | * | 11/2002 | Hornby | 239/585.1 |
| 6,510,836 | B2 | * | 1/2003 | Ismailov | 123/299 |
| 6,550,690 | B2 | * | 4/2003 | Dallmeyer et al. | 239/5 |
| 6,648,298 | B2 | * | 11/2003 | Souma et al. | 251/129.21 |
| 6,651,628 | B2 | * | 11/2003 | Nally | 123/470 |
| 6,695,232 | B2 | * | 2/2004 | Dallmeyer et al. | 239/585.1 |
| 6,718,949 | B2 | * | 4/2004 | Gmelin | 123/470 |
| 6,769,636 | B2 | * | 8/2004 | Dallmeyer et al. | 239/585.1 |
| 6,811,091 | B2 | * | 11/2004 | Dallmeyer et al. | 239/5 |
| 6,874,477 | B1 | * | 4/2005 | Lorraine et al. | 123/468 |
| 7,296,781 | B2 | * | 11/2007 | Akabane | 251/129.21 |
| 7,571,868 | B2 | | 8/2009 | Bayer | |
| 2003/0218081 | A1 | * | 11/2003 | Kato et al. | 239/585.1 |

FOREIGN PATENT DOCUMENTS

| | | |
|---|---|---|
| DE | 40 03 227 | 1/1991 |
| DE | 19712591 | 10/1998 |
| DE | 19946602 | 4/2001 |
| DE | 102004033280 | 2/2006 |
| JP | 2-106062 | 4/1990 |

(Continued)

*Primary Examiner* — Jason J Boeckmann
(74) *Attorney, Agent, or Firm* — Kenyon & Kenyon LLP

(57) ABSTRACT

A fuel injector has a solenoid which cooperates with an armature acted upon by a restoring spring, the armature, together with a valve needle, forming an axially movable valve part. A valve closing body which forms a seat seal with a valve seat body is provided on the valve needle, the seat being form-fitted in a seat support which forms the downstream interface to the inlet pipe or the combustion chamber and is made of plastic. The connection fitting, which forms the upstream interface to the central fuel supply, is preferably also manufactured from plastic.

31 Claims, 2 Drawing Sheets

FOREIGN PATENT DOCUMENTS

| | | |
|---|---|---|
| JP | 8-338346 | 12/1996 |
| JP | 2530850 | 4/1997 |
| JP | 11-210596 | 8/1999 |
| JP | 2001-115923 | 4/2001 |
| JP | 2002-89400 | 3/2002 |
| JP | 2003-161222 | 6/2003 |
| WO | WO 01/66933 | 9/2001 |
| WO | WO 2004/033895 | 4/2004 |

* cited by examiner

FUEL INJECTOR

BACKGROUND INFORMATION

German Patent Application No. DE 40 03 227, for example, describes a fuel injector having a core surrounded by a solenoid; an armature via which a valve closing body cooperating with a stationary valve seat is operable via a connecting tube welded to the armature; a tubular metallic intermediate part whose one end is hermetically welded to an end of the core facing the armature and whose other end is hermetically welded to a tubular connecting part, and having at least one bow-shaped conducting element, which overlaps the solenoid, whose end facing the valve closing body is connected to the connecting part and whose other end is welded to the core, each of two overlapping components of the fuel injector being welded in a cross-section reduction of one of the two parts to be welded.

A disadvantage of the fuel injector known from the above-mentioned publication is in particular that the connections between the individual components of the fuel injector are complicated and therefore time- and cost-intensive to manufacture. Furthermore, the welded parts are subjected to thermal stress, which reduces their strength and flexural rigidity; this may result in considerable resonance via housing parts having different thicknesses and the associated noise generation during the operation of the fuel injector.

SUMMARY OF THE INVENTION

The fuel injector according to the present invention has the advantage over the related art that the use of metals remains limited to the elements that are essential for the function of the fuel injector. Due to the fact that both connecting pieces are manufactured from plastic, the cost-intensive and sensitive welds between metallic components such as described in German Patent Application No. DE 40 03 227 are no longer necessary. The use of plastic as the material makes both a cost-effective design and simple assembly of the connecting pieces, as well as weight reduction of the fuel injector, possible.

Furthermore, manufacturing the seat support and the connection fitting from plastic makes variety and flexibility regarding color coding, length variation of the upstream and/or downstream connecting piece and various geometries of the connecting pieces such as groove positions, groove geometries, and anti-twist lugs possible, the orientation of the fuel injector with respect to the inlet pipe being more precise if the lug is mounted on the seat support and the corresponding groove in the inlet pipe. The seat support and connection fitting manufactured from plastic also have the advantage that noise-dampening thermoplastics may be used as the material, the material being subjected to less stress if noise is generated during operation of the fuel injector, because the noise generated is damped by the material used.

The use of plastic as the material for manufacturing the seat support and connection fitting allows the design of these connecting parts to be adapted to the plastic, it being advantageous in particular that the wall thickness of the parts manufactured from plastic does not vary in mass production. In addition, the use of plastic in mass manufacture allows maximum stiffness of the connecting parts with maximum dimensional stability and minimum material use.

Coating the solenoid, including the connector, with plastic advantageously allows full variety and flexibility regarding connector geometries and color coding at a reasonable cost.

It is furthermore advantageous that the filter screen may be incorporated in the connection fitting without a split taper socket. This reduces the number of components and consequently also the overall cost of the fuel injector.

It is furthermore advantageous that an ultrasound- or laser-welded filter makes proper deformation of the O-ring possible, resulting in good surface quality without parting of the mold.

Another advantage of the injector according to the present invention is that the seat support may twist continuously with respect to the valve housing. The use of another injection molding mold for manufacturing fuel injectors differing by the radial positions of their injection openings is therefore unnecessary. This means that fuel injectors differing by the radial positions of their injection openings may thus be produced in a single production line.

The design of the fuel injector according to the present invention permits the use of existing assembly facilities for mass production of the fuel injector according to the present invention; the connection fitting may also be assembled after dynamically setting the fuel amount to be delivered. The advantage of shorter process times for the adjusting stamps results, because process changeover in the event of a type change regarding connection fitting length of the fuel injector to be manufactured is no longer absolutely necessary, and the same assembling machine may be used for mass production of fuel injectors of different types.

DETAILED DESCRIPTION

An exemplary embodiment of the present invention is described below as an example with reference to FIG. 1.

Figure 1:
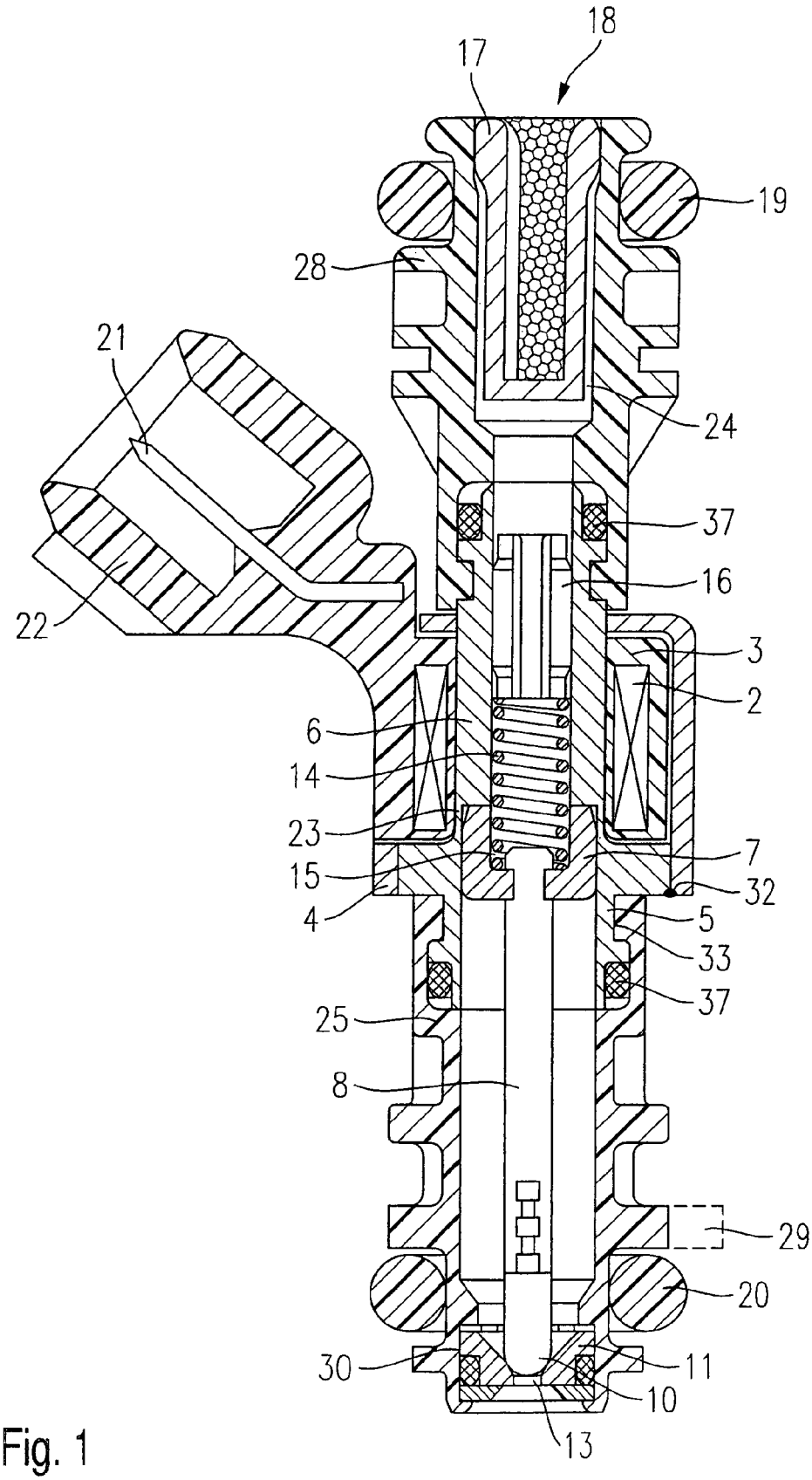
FIG. 1 schematically shows a section through an exemplary embodiment of a fuel injector designed according to the present invention.

FIG. 1 schematically shows a longitudinal section through an exemplary embodiment of a fuel injector 1 designed according to the present invention, which is suitable in particular for injecting fuel into an inlet pipe (not illustrated in detail) of an internal combustion engine.

Fuel injector 1 includes a solenoid 2, which is wound onto a field spool 3. Field spool 3 is encapsulated in a pot-shaped valve housing 4. A tube-shaped valve sleeve 5, which is used as a seat support receptacle, among other things, and represents an extension of an internal pole 6, goes through field spool 3. An armature 7, which is connected to a valve needle 8 by press fitting, is situated downstream from internal pole 6. Valve sleeve 5 and valve housing 4 are permanently connected via a laser weld 32.

Valve needle 8 is operatively linked to a valve closing body 10, which is rod-shaped in this exemplary embodiment and forms a seat seal with a valve seat body 11. Downstream from the seat seal, at least one injection opening 13 is formed, from which fuel is injected into the inlet pipe (not illustrated in detail).

In the rest position of fuel injector 1, armature 7 is acted upon by a restoring spring 14 in such a way that fuel injector 1 is held closed onto valve seat body 11 by the pressure of valve closing body 10. Restoring spring 14 is situated in a recess 15 of armature 7, and is pre-stressed by an adjusting sleeve 16. A pot-shaped filter element 17 is inserted into a connection fitting 28 on the inlet side of adjusting sleeve 16. The fuel, which is supplied via a central fuel supply 18, flows through fuel injector 1 via an inlet tube 24, recess 15, and flows to valve seat body 11 and injection opening 13.

The area of central fuel supply 18 of fuel injector 1 is provided with a seal 19 for installation on a fuel distribution line (not illustrated in detail). Another seal 20 seals the connection (not illustrated in detail) between fuel injector 1 and the inlet pipe. The inlet pipe is not illustrated in detail here because it is irrelevant to the core of the present invention. Solenoid 2 is excited by an electric current which may be supplied via a line and an electrical plug-in contact 21. Plug-in contact 21 is surrounded by a plastic sheathing 22, which may be extruded on valve sleeve 5 and/or supply tube 24.

If an electric current is supplied to solenoid 2 via an electric line (not illustrated in detail), an electric field is formed, which, if sufficiently strong, attracts armature 7 against the force of restoring spring 14 and against the direction of the fuel flow into solenoid 2. This closes a working gap 23 formed between armature 7 and supporting tube 6. Valve needle 8, form-fittingly connected to armature 7, is entrained by the movement of armature 7 in the direction of lift in such a way that valve closing body 10 is lifted from valve seat body 11 and fuel is supplied to injection opening 13.

Fuel injector valve 1 is closed as soon as the current which excites solenoid 2 is switched off and the magnetic field intensity decreases to the point that restoring spring 14 presses armature 7 off supporting tube 6, moving valve needle 8 in the downstream direction and setting valve closing body 10 on valve seat body 11.

Due to bending vibrations, fuel injectors tend to emit undesirable noise during operation. This is due to the shape of valve sleeve 5, which has a support function, while its material thickness must be sufficiently small to permit a magnetic field to build up sufficiently in the area of the working air gap.

Figure 2:
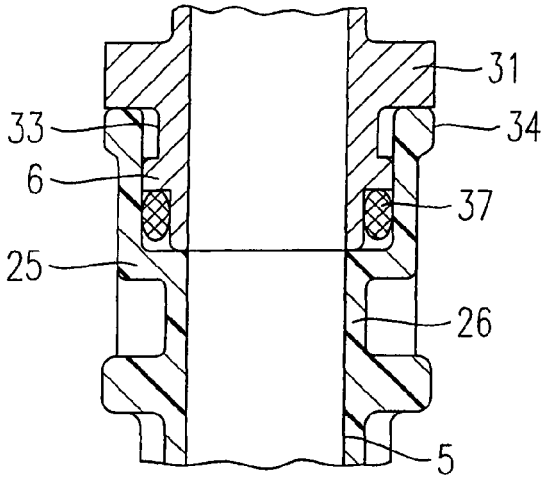
FIG. 2 schematically shows a partial section through the fuel injector according to the present invention corresponding to a first exemplary embodiment.

FIG. 2 schematically shows a partial section through inlet area 26 of a seat support 25 made of plastic according to a first exemplary embodiment. Inlet area 26 of seat support 25 is attached to a recess 33 of valve sleeve 5, in that an annular bulge 34 of inlet area 26 of seat support 25 is molded into recess 33 of valve sleeve 5 underneath flange 31 of valve sleeve 5 using a heated stamp or ultrasound power. Connection fitting 28 on internal pole 6 may be attached in a recess in a comparable way (FIG. 1).

The connection areas between connection fitting 28 and internal pole 6, and between seat support 25 and valve sleeve 5 are sealed using O-rings 37, for example. A projecting anti-twist lug 29, which is easily moldable on plastic seat support 25, may be provided on seat support 25 to ensure a defined position of the fuel injector after assembly.

Figure 3:
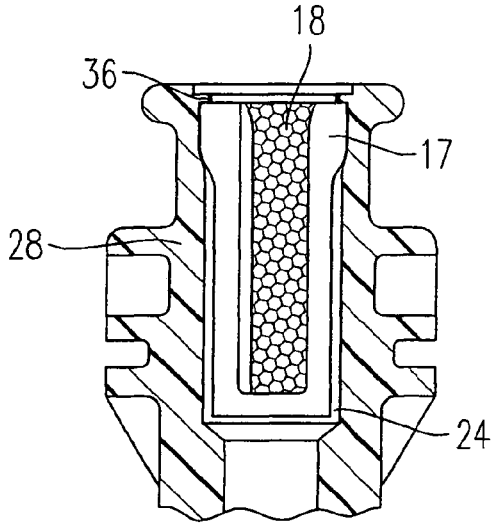
FIG. 3 schematically shows a second partial section through the fuel injector according to the present invention corresponding to a second exemplary embodiment.

FIG. 3 schematically shows a partial section through connection fitting 28 corresponding to a second exemplary embodiment. A caulking 36, applied peripherally—continuously, or discretely spaced at 90°—is located on the inlet end of connection fitting 28, filter element 17 being attached to the inlet-side end of connection fitting 28 either by ultrasound or by heating.

Figure 4:
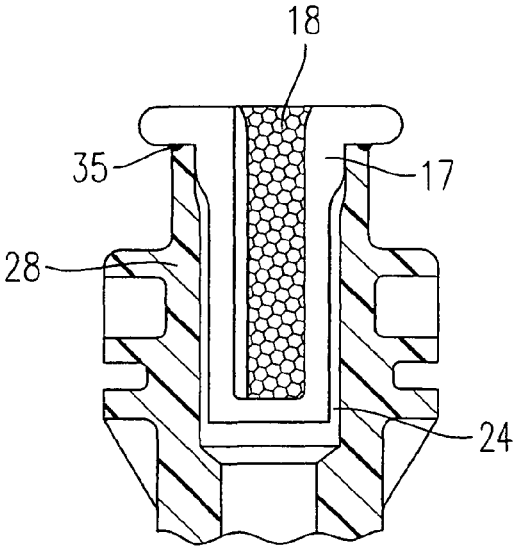
FIG. 4 schematically shows a partial section through the fuel injector according to the present invention corresponding to a third exemplary embodiment.

FIG. 4 schematically shows a partial section through connection fitting 28 corresponding to a third exemplary embodiment. Filter element 17, attached to connection fitting 28 by a weld 35, is located on the inlet-side end of connection fitting 28. The weld is formed either by laser welding or ultrasound welding.

The present invention is not limited to the exemplary embodiments illustrated. In particular, any combinations of the different features are possible, for example, either connection fitting 28 or seat support 25 may be made of plastic.

What is claimed is:

1. A fuel injector comprising:

an armature;

a restoring spring acting upon the armature;

a solenoid cooperating with the armature;

a valve needle, the armature together with the valve needle forming an axially movable valve part;

a valve seat body;

a valve closing body forming a seat seal with the valve seat body, situated on the valve needle;

a valve sleeve;

at least one connection fitting as an upstream connection of the fuel injector; and a seat support as a downstream connection of the fuel injector, wherein at least one of the connection fitting and the seat support is composed of plastic;

wherein a first connection of the connection fitting to the valve sleeve is sealed by a first O-ring, the first connection being form-fitted to the valve sleeve upstream of the solenoid;

wherein a second connection of the seat support to the valve sleeve is sealed by a second O-ring, the second connection being form-fitted to the valve sleeve downstream of the solenoid;

wherein an upstream end face of the connection fitting forms an upstream end of the fuel injector; and wherein an upstream-side section of the valve sleeve is configured as an internal pole, and the connection fitting is form-fitted in a recess of the internal pole in such a way that a fixed connection is produced between the connection fitting and the internal pole.

2. The fuel injector according to claim 1, wherein the connection fitting is composed of a noise-dampening material.

3. The fuel injector according to claim 1, wherein the fuel injector is color coded by using a plastic granulate.

4. The fuel injector according to claim 1, wherein the connection fitting has a lug extruded onto it for preventing the fuel injector from twisting in an inlet pipe.

5. The fuel injector according to claim 1, wherein the seat support is composed of a noise-dampening material.

6. The fuel injector according to claim 5, wherein the fuel injector is color coded by using a plastic granulate.

7. The fuel injector according to claim 1, wherein the seat support is form-fitted in a recess of a seat support receptacle in such a way that a fixed connection is produced between the seat support and the seat support receptacle.

8. The fuel injector according to claim 7, wherein the seat support has a lug extruded onto it for preventing the fuel injector from twisting in a corresponding groove in an inlet pipe.

9. The fuel injector according to claim 1, further comprising a filter element pressed into the connection fitting, the filter element being one of form-fitted, warm-caulked, caulked, and welded to the connection fitting.

10. A fuel injector comprising:

an armature;

a restoring spring acting upon the armature;

a solenoid cooperating with the armature;

a valve needle, the armature together with the valve needle forming an axially movable valve part;

a valve seat body;

a valve closing body forming a seat seal with the valve seat body, situated on the valve needle;

a valve sleeve;

at least one connection fitting as an upstream connection of the fuel injector; and a seat support as a downstream connection of the fuel injector, wherein at least one of the connection fitting and the seat support is composed of plastic;

wherein a first connection of the connection fitting to the valve sleeve is sealed by a first O-ring, the first connection being form-fitted to the valve sleeve upstream of the solenoid;

wherein a second connection of the seat support to the valve sleeve is sealed by a second O-ring, the second connection being form-fitted to the valve sleeve downstream of the solenoid;

wherein an upstream end face of the connection fitting forms an upstream end of the fuel injector; and wherein the valve sleeve has a flange, to which an inlet-side area of the seat support is attached, an annular bulge of the seat support being molded into a recess of the valve sleeve.

11. A fuel injector comprising:

an armature;

a restoring spring acting upon the armature;

a solenoid cooperating with the armature;

a valve needle, the armature together with the valve needle forming an axially movable valve part;

a valve seat body;

a valve closing body forming a seat seal with the valve seat body, situated on the valve needle;

a valve sleeve;

at least one connection fitting as an upstream connection of the fuel injector, wherein an annular seal surrounds part of an upstream end of the connection fitting; and a seat support as a downstream connection of the fuel injector, wherein the connection fitting and the seat support are composed of plastic;

wherein a first connection of the connection fitting to the valve sleeve is sealed by a first O-ring, the first connection being form-fitted to the valve sleeve upstream of the solenoid;

wherein a second connection of the seat support to the valve sleeve is sealed by a second O-ring, the second connection being form-fitted to the valve sleeve downstream of the solenoid;

wherein an upstream end face of the connection fitting forms an upstream end of the fuel injector; and wherein an upstream-side section of the valve sleeve is configured as an internal pole, and the connection fitting is form-fitted in a recess of the internal pole in such a way that a fixed connection is produced between the connection fitting and the internal pole.

12. The fuel injector according to claim 11, wherein the connection fitting is composed of a noise-dampening material.

13. The fuel injector according to claim 11, wherein the fuel injector is color coded by using a plastic granulate.

14. The fuel injector according to claim 11, wherein the connection fitting has a lug extruded onto it for preventing the fuel injector from twisting in an inlet pipe.

15. The fuel injector according to claim 11, wherein the seat support is composed of a noise-dampening material.

16. The fuel injector according to claim 15, wherein the fuel injector is color coded by using a plastic granulate.

17. The fuel injector according to claim 11, wherein the seat support is form-fitted in a recess of a seat support receptacle in such a way that a fixed connection is produced between the seat support and the seat support receptacle.

18. The fuel injector according to claim 17, wherein the seat support has a lug extruded onto it for preventing the fuel injector from twisting in a corresponding groove in an inlet pipe.

19. The fuel injector according to claim 11, further comprising a filter element pressed into the connection fitting, the filter element being one of form-fitted, warm-caulked, caulked, and welded to the connection fitting.

20. A fuel injector comprising:

an armature;

a restoring spring acting upon the armature;

a solenoid cooperating with the armature;

a valve needle, the armature together with the valve needle forming an axially movable valve part;

a valve seat body;

a valve closing body forming a seat seal with the valve seat body, situated on the valve needle;

a valve sleeve;

at least one connection fitting as an upstream connection of the fuel injector, wherein an annular seal surrounds part of an upstream end of the connection fitting; and a seat support as a downstream connection of the fuel injector, wherein the connection fitting and the seat support are composed of plastic;

wherein a first connection of the connection fitting to the valve sleeve is sealed by a first O-ring, the first connection being form-fitted to the valve sleeve upstream of the solenoid;

wherein a second connection of the seat support to the valve sleeve is sealed by a second O-ring, the second connection being form-fitted to the valve sleeve downstream of the solenoid;

wherein an upstream end face of the connection fitting forms an upstream end of the fuel injector; and wherein the valve sleeve has a flange, to which an inlet-side area of the seat support is attached, an annular bulge of the seat support being molded into a recess of the valve sleeve.

21. A fuel injector comprising:

an armature;

a restoring spring acting upon the armature;

a solenoid cooperating with the armature;

a valve needle, the armature together with the valve needle forming an axially movable valve part;

a valve seat body;

a valve closing body forming a seat seal with the valve seat body, situated on the valve needle;

at least one connection fitting as an upstream hydraulic connection of the fuel injector; and a seat support as a downstream hydraulic connection of the fuel injector, wherein the connection fitting and the seat support are composed of plastic;

wherein an inner wall of the connection fitting delimits a first interior space through which fuel flows;

wherein the inner wall of the connection fitting is in direct physical contact with the flowing fuel;

wherein an entire inner-wall surface of the connection fitting, with which the fuel is in direct physical contact, is composed of plastic;

wherein an inner wall of the seat support delimits a second interior space through which the fuel flows;

wherein the inner wall of the seat support is in direct physical contact with the flowing fuel;

wherein an entire inner-wall surface of the seat support, with which the fuel is in direct physical contact, is composed of plastic.

22. The fuel injector according to claim 21, wherein the connection fitting is composed of a noise-dampening material.

23. The fuel injector according to claim 21, wherein the fuel injector is color coded by using a plastic granulate.

24. The fuel injector according to claim 21, wherein the connection fitting is form-fitted in a recess of an internal pole in such a way that a fixed connection is produced between the connection fitting and the internal pole.

25. The fuel injector according to claim 24, wherein the connection fitting has a lug extruded onto it for preventing the fuel injector from twisting in an inlet pipe.

26. The fuel injector according to claim 21, wherein the seat support is composed of a noise-dampening material.

27. The fuel injector according to claim 26, wherein the fuel injector is color coded by using a plastic granulate.

28. The fuel injector according to claim 21, wherein the seat support is form-fitted in a recess of a seat support receptacle in such a way that a fixed connection is produced between the seat support and the seat support receptacle.

29. The fuel injector according to claim 28, wherein the seat support has a lug extruded onto it for preventing the fuel injector from twisting in a corresponding groove in an inlet pipe.

30. The fuel injector according to claim 21, further comprising a filter element pressed into the connection fitting, the filter element being one of form-fitted, warm-caulked, caulked, and welded to the connection fitting.

31. The fuel injector according to claim 21, further comprising a valve sleeve having a flange, to which an inlet-side area of the seat support is attached, an annular bulge of the seat support being molded into a recess of the valve sleeve.

* * * * *